US005195572A

United States Patent [19]

Linden, Jr. et al.

[11] Patent Number: 5,195,572

[45] Date of Patent: Mar. 23, 1993

[54] TWO PART SHOT SLEEVE FOR DIE CASTING

[75] Inventors: Henry Linden, Jr.; Bobby J. Smith, both of Grafton; Barry F. Bronson, Mentor; Dennis J. Sobol, Cleveland, all of Ohio

[73] Assignee: Rex-Buckeye Company, Inc., Cleveland, Ohio

[21] Appl. No.: 799,674

[22] Filed: Nov. 21, 1991

Related U.S. Application Data

[63] Continuation of Ser. No. 607,593, Oct. 31, 1990, abandoned, which is a continuation of Ser. No. 378,064, Jul. 11, 1989, abandoned.

[51] Int. Cl.[5] ..... B22D 17/08; B22D 17/30

[52] U.S. Cl. ..... 164/312; 164/313

[58] Field of Search ..... 164/312, 313, 314, 315

[56] References Cited

U.S. PATENT DOCUMENTS

| | | | |
|---|---|---|---|
| 2,656,568 | 10/1953 | Watkin et al. | 164/314 |
| 3,664,411 | 5/1972 | Carver et al. | 164/312 |
| 3,672,440 | 6/1972 | Miura | 164/312 |

FOREIGN PATENT DOCUMENTS

| | | | |
|---|---|---|---|
| 278208 | 8/1988 | European Pat. Off. | 164/312 |

OTHER PUBLICATIONS

Rex-Buckeye Company Sales Literature, Bulletin 202 2M, Feb., 1979.

F.lli Vedani Engineering Pamphlet.

*Primary Examiner*—Richard K. Seidel

*Assistant Examiner*—Rex E. Pelto

*Attorney, Agent, or Firm*—Renner, Otto, Boisselle & Sklar

[57] ABSTRACT

A two-piece shot sleeve for use with a die casting machine including first and second cylindrical sleeve sections being removably axially secured together, each open at both ends and including an interior passage for the flow of molten metal, the second sleeve section also including a pour hole for receiving molten metal into the interior passage. The invention also relates to a die casting machine including a die, a source of molten liquid for casting, a two-piece shot sleeve including a die end section and a pour end section, a plunger disposed within shot sleeve for forcing molten liquid through the shot sleeve into the die and, a ram for moving plunger axially within shot sleeve, wherein the pour end section of the two-piece shot sleeve is removable from the machine without removing the die end section. Further disclosed is an improved die casting machine which includes a die, a source of molten liquid for casting, a supply path for conducting liquid to the die, and a plunger and ram to force the liquid along the path into the die, the improvement including facilitating removal and replacement of at least part of the supply path.

11 Claims, 2 Drawing Sheets

TWO PART SHOT SLEEVE FOR DIE CASTING

This is a continuation of copending application(s) Ser. No. 07/607,593 filed on Oct. 31, 1990, which is a continuation of Ser. No. 07/378,064 filed Jul. 11, 1989, both now abandoned.

TECHNICAL FIELD OF THE INVENTION

This invention relates generally to die casting machines, and, more in particular, to shot sleeves for transferring molten metal in such a machine.

BACKGROUND OF THE INVENTION

Machines for die casting various metals, such as aluminum, brass, zinc, magnesium, etc., have been known for many years. In one particular type of die casting machine, a gravity feed machine, molten metal is ladled into a shot sleeve through a pour hole. A plunger operating within the shot sleeve then forces the molten metal to flow through the sleeve into an affixed die.

One problem that has plagued die casting machines is that the molten metals tend to react chemically, thermally and/or metallurgically with the materials, usually steel or a steel alloy, that compose the shot sleeve wherever they come into contact. This reaction is especially prevalent when the molten metal exceeds a prescribed temperature at which such reaction occurs or is promoted. This reaction tends to corrode and to erode deformities into the surface of the shot sleeve hindering and eventually precluding effective operation of the die casting machine and, thus, requiring replacement of the shot sleeve. Especially troublesome damaging reactions have been found to occur when aluminum was the cast metal due its particularly high casting temperature (around 1200 degrees F. or greater).

Replacement of the shot sleeve is an expensive and time consuming task due in part to the size and cost of the sleeve and and its intimate engagement with the die.

SUMMARY OF THE INVENTION

One aspect of the invention is the provision of a two piece shot sleeve wherein the section of the sleeve suffering the greatest amount of erosion and corrosion is easily replaceable and relatively inexpensive.

Another aspect is the facility of the changing of at least part of a shot sleeve or similar wearing part of a die casting or other similar machine.

In accordance with the invention, a two-piece shot sleeve for use with a die casting machine includes first and second cylindrical sleeve sections, each open at both ends and including an interior passage for the flow of molten metal and mounting means for removably axially securing with the other sleeve section; the second sleeve section also including means for receiving molten metal into said interior passage.

The invention also relates to a die casting machine including a die, a source of molten liquid for casting; a two-piece shot sleeve including a die end section and a pour end section; a plunger disposed within the shot sleeve for forcing molten liquid through the shot sleeve into the die; and, a ram for moving the plunger axially within the shot sleeve, wherein the pour end section of the two-piece shot sleeve is removable from the machine without removing the die end section.

The invention further relates to an improvement in a die casting machine which includes a die, a source of molten liquid for casting, a supply path for conducting liquid to the die, and means to force liquid along the path into the die, the improvement including means for facilitating removal and replacement of at least part of the supply path.

These and other objects, advantages, features and aspects of the present invention will become apparent as the following description proceeds.

To the accomplishment of the foregoing and related ends, the invention, then, comprises and features hereinafter fully described in the specification and particularly pointed out in the claims, the following description and the annexed drawings setting forth in detail a certain illustrative embodiment of the invention, this being indicative, however, of but one of the various ways in which the principles of the invention may be employed. It will be appreciated that the scope of the invention is to be determined by the claims and the equivalents thereof.

DETAILED DESCRIPTION OF THE INVENTION

Figure 1:
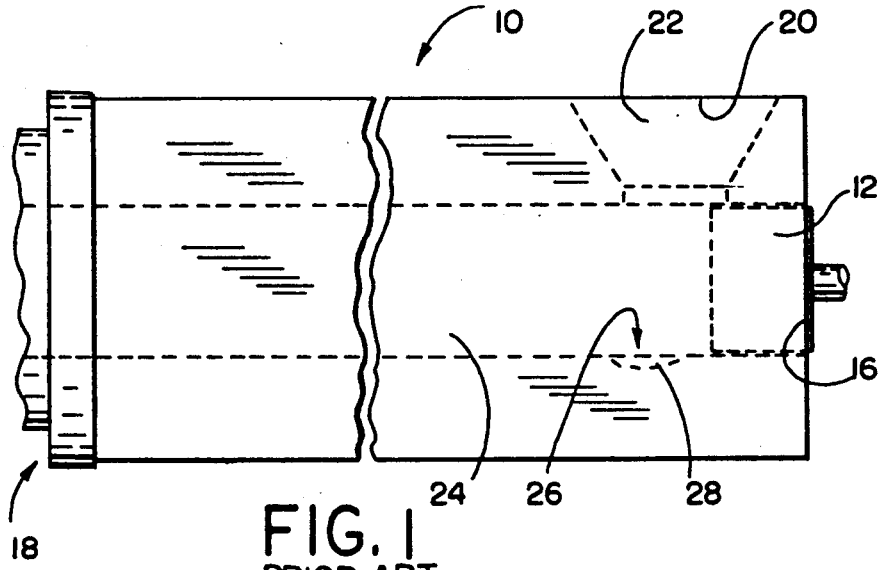
FIG. 1 PRIOR ART
FIG. 1 is an illustration of a prior art shot sleeve in conjunction with a plunger for moving molten metal through the shot sleeve into a die.

With reference to the several figures in which like reference numerals depict like items, and specifically to FIG. 1 there is shown prior art shot sleeve 10 employed with a plunger 12 and die (not shown). The shot sleeve 10 is a generally a long cylindrical steel tube open at both axial ends. A plunger 12 is disposed within the shot sleeve for axially reciprocal movement therein. A plunger rod 14 is secured to the rear face 16 of the plunger 14 and extends through the open pour end of the shot sleeve 10 to a hydraulic ram (not shown). The hydraulic ram transfers power to the plunger 12 through the rod 14 to accomplish the axial movement. The shot sleeve 10 is fixed at the die open end 18 to the platen, or stationary section of the die assembly. At the upper circumferential surface 20 of the shot sleeve 10 proximate the plunger 12 there is located a generally conical passage 22, called a pour hole 22, extending from the top of the sleeve through the sleeve cylindrical wall into the interior recess 24 of the sleeve.

In operation molten metal, such as, aluminum for example, is ladled into the pour hole 22 by manual means or with automatic means such as a programmed robot arm or other automatic ladle apparatus. The molten metal flows through the pour hole into the interior passage 24 of the sleeve 10 contacting the bottom surface at a general area known as the pour section 26, and then spreading out in the passage 24. After a predetermined quantity of molten metal has been ladled into the shot sleeve 10, the hydraulic ram forces the plunger 12 (from its retracted location) to extend axially towards the die end 18 of the shot sleeve 10, the plunger 12 in turn closing the pour hole 22 and forcing the molten metal out of the shot sleeve and into the die. The hydraulic ram will then return the plunger 12 to the retracted location and end of its stroke and the process will begin again.

As molten metal repeatedly contacts and flows across the pour section 26 of the sleeve 10 it reacts chemically, thermally and/or metallurgically with the steel surface of the interior passage 24 of the shot sleeve eroding and corroding it and causing a continually deepening depression generally indicated at 28 in the area of the pair section. Over time this deepening depression becomes filled with solidified pour metal which scrapes and wears the plunger 12 at this surface. Once this effect becomes too great the die casting operation must be shut down while the shot sleeve 10 is replaced. Since the shot sleeve 10 can be very large, sometimes as large as 11 inches in diameter and 45 inches long, is quite heavy and its removal requires disconnecting of the platen and die assembly, the replacement tends to be rather difficult, time-consuming, and expensive. Moreover, the large volume of steel in a replacement shot sleeve is quite expensive, exclusive of the costs of machining it.

The use of a programmed robot arm or other automated ladling apparatus over the manual method of ladling the molten metal into the pour hole 22 has the advantages of being almost exactly repeatable, while removing the human from the intense heat and otherwise undesirable environment near the ladling. Unfortunately the robot arm or automated ladling apparatus also causes the molten metal to contact the pour section at approximately the same area with every repetition. This confined area of contact increases the rate of erosion in this area markedly, thus shortening the life of the shot sleeve 10 even further.

Due to the short life of a shot sleeve and the long replacement times, some die casting manufacturers have taken to running an eight hour day casting dies, and then have had to devote at least a major part of a next shift to the replacement of the shot sleeve.

Referring now to FIGS. 2–11, there is shown a two-piece shot sleeve 30, in accordance with the present invention, that greatly reduces the cost and downtime associated with the replacement of a worn conventional shot sleeve. The shot sleeve 30 of the present invention is composed of two axially joining sections 32, 34. One section 32 of the shot sleeve 30 is affixed to the platen of the die (not shown) and remains fixed throughout operation and replacement. It will therefore be referred to hereinafter as the fixed sleeve 32. Shot sleeve section 34 containing the pour hole 36 and being most proximate the plunger 38 and hydraulic ram assembly is removably secured to the fixed sleeve 32 and will therefore be referred to below as the removable sleeve 34. Both sections are preferably composed of a high temperature resistant material, such as, for example, heat-treated steel.

The removable sleeve 34 is preferably only as long as necessary to house the plunger 38 and pour hole 36 and to connect securely to the fixed section 32. Therefore, the removable shot sleeve 34 is generally substantially shorter than the fixed sleeve 34, depending on the overall length of the joined sections.

As in the prior art shot sleeves, the joined two-piece shot sleeve 30 is cylindrically shaped with an axial cylindrical passage 40 open at both the die and pour ends 42, 44, respectively. A plunger 36 powered by a hydraulic ram (not shown) is likewise located within the shot sleeves 32, 34 with a plunger rod extending out of the open pour end 44 of the removable sleeve 34 connecting the plunger 38 and the ram. The fixed sleeve section 32 is secured to the stationary platen of the die. The pour hole 36 is shaped as a conical passage with its widest diameter intersecting the top outer surface 46 of the removable shot sleeve 34 and its taper extending into the interior axial passage 40 also as in the prior art. It is also common to terminate the taper partially through the sleeve cylinder wall 50 at a constant diameter bore 52 extending into the interior passage 40.

The fixed sleeve 32 and removable sleeve 34 are joined axially using any of a variety of securement means that provide a tight interface preventing the penetration of the molten metal between the mating surfaces. Several examples are presented below. It will be appreciated that features of the various embodiments described below also may be used with other embodiments.

Figure 2:
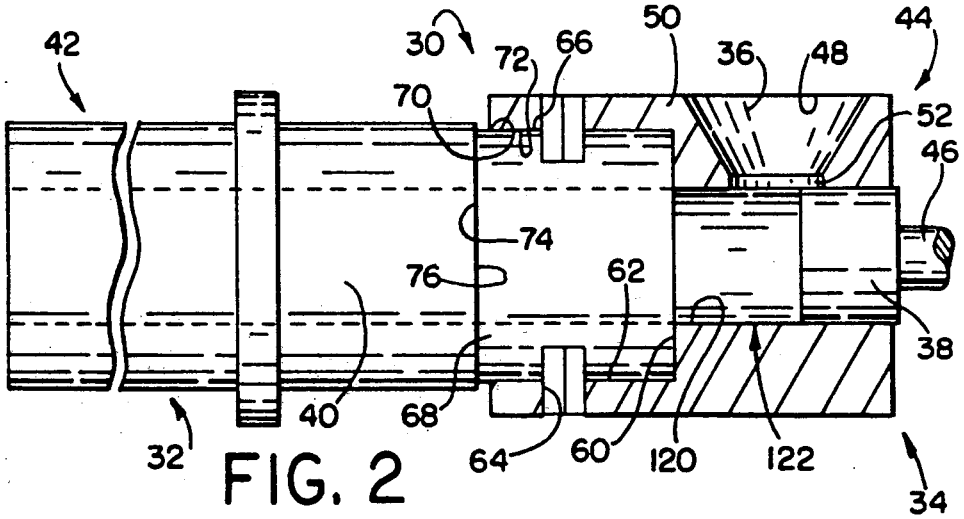
FIG. 2 shows the two-piece shot sleeve of the present invention secured by rectangular wedges.
Figure 3:
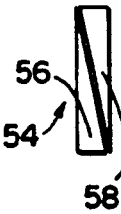
FIG. 3 is an illustration of the rectangular wedges securing the sleeve sections of FIG. 2.

Referring specifically to FIGS. 2 and 3 there is shown a wedging mechanism 54 including rectangular wedges 56, 58 for securing the fixed and removable sleeves 32, 34 together. In this embodiment the cylindrical wall 50 of the removable sleeve 34 is provided with an annular recess 60 for engagement with a reduced outer diameter area 62 on the fixed sleeve 32. Two square recesses 64, 66 located 180 degrees apart extend through the removable sleeve 34 and partially into the cylindrical wall 68 of the fixed sleeve 32 in the area of their radially opposing mating surfaces 70, 72. By inserting rectangular wedges 56, 58 into the square recesses 64, 66 the axially opposing mating surfaces 74, 76 of the sleeves are drawn tightly together.

Figure 4:
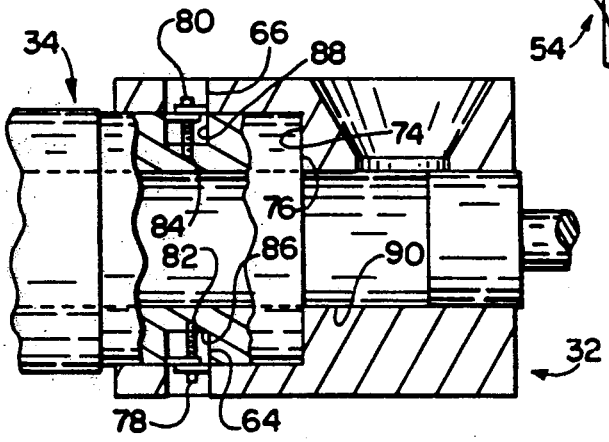
FIG. 4 shows the two-piece shot sleeve of the present invention secured by a cam lock.
Figure 5:
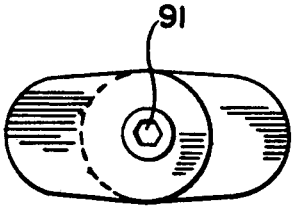
FIG. 5 is an elevation of a double-acting cam of FIG. 4.
Figure 6:
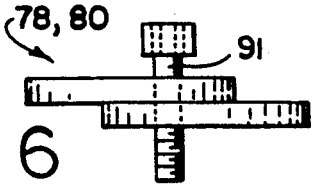
FIG. 6 is a top view of the double-acting cam.

Referring to FIGS. 4–6 a similar embodiment employing locking cams 78, 80 in the opposing square recesses 64, 66 is shown. The recesses 64, 66 are shown in the same area as described in FIG. 2, however, the depth of the recesses extending into the fixed sleeve 32 are slightly shallower to allow for tapped holes 82, 84 to be provided in their bottom surfaces 86, 88. The tapped holes 82, 84 extend radially inwardly toward the center of the sleeve 34 stopping before penetrating the inner wall surface 90 of the fixed sleeve 34. Double acting cams 78, 80 affixed to a threaded machine screw 91 are inserted into each of the recesses 64,66 and the assemblies are threaded into the tapped holes 82, 84. Upon rotation through 180 degrees the cams 78, 80 press against the inner surfaces of the recesses 64, 66 exerting opposing forces in the axial direction to urge the axially opposing wall sections 74, 76 of the sleeves 32, 34 together tightly.

Figure 7:
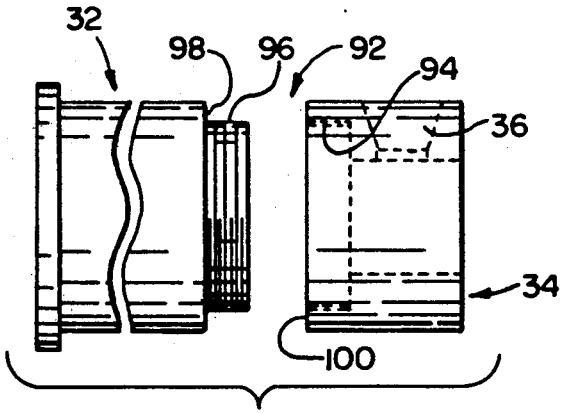
FIG. 7 is an illustration of the two-piece shot sleeve of the present invention secured in thread connection.
Figure 8:
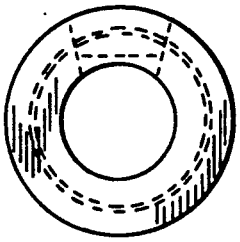
FIG. 8 is an end view of the two-piece sleeve of FIG. 7.

Another embodiment of the securement means between the fixed and removable sleeves 32, 34, respectively, includes a threaded engagement 92 as shown FIGS. 7 and 8. The removable sleeve 34 is provided with a threaded annular recess 94 suitable for threaded engagement onto a threaded reduced diameter area 96 of the fixed sleeve 32. Upon rotation of the removable sleeve 34 in the appropriate direction, axially opposing wall members 98, 100 on the sleeves 32, 34 will bind tightly together as the pour hole 36 of the removable sleeve reaches its required vertical orientation.

Figure 9:
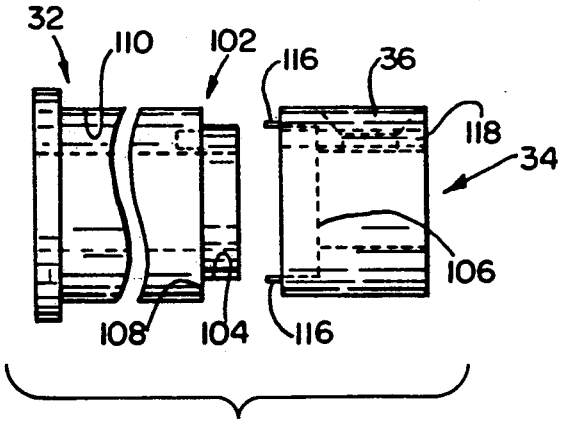
FIG. 9 is an illustration of a two-piece shot sleeve in accordance with the present invention secured by bolting.
Figure 10:
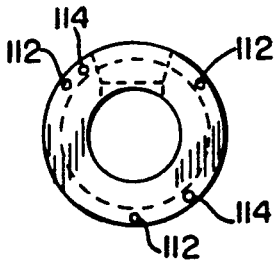
FIG. 10 is an end view of the two-piece shot sleeve of FIG. 9.

FIGS. 9 and 10 illustrate yet another manner in which the fixed sleeve 32 and removable sleeve 34 may be secured together. The fixed sleeve 32 has a stepped outer circumference 102 with the reduced diameter extension 104 at the end nearest the removable sleeve 34. The removable sleeve 34 includes an annular recess 106 nearest the fixed sleeve 32 such that the reduced diameter extension 104 of the fixed sleeve will fit closely therein. The radially extending wall section 108 formed at the step between the outer fixed sleeve circumference 110 and the reduced diameter extension 104 includes three tapped holes 112 spaced at 120 degree intervals and two diametrically opposed untaped holes 114. The removable sleeve 34 is provided with two dowel rods 116 opposite the untapped holes 114 in the fixed sleeve 32 for orienting the sleeves so that the pour hole 36 opens vertically upwardly. Three axial clearance holes 118 (only one of which is shown) through the removable sleeve 34 spaced 120 degrees apart accept machine screws (not shown) for threaded connection with the tapped holes 112 to firmly secure the sleeves 32, 34.

Alternatively, the dowel rods and corresponding holes could be substituted with counterbores and matching protrusions in the mating surfaces for alignment.

In operation a die casting machine embodying the two-piece shot sleeve 30 of the present invention will function identically to die casting machines having conventional shot sleeves. The molten metal is ladled into the pour hole 36 of the removable sleeve 32 where it will initially contact the bottom surface 120 of the sleeve, in a general area called the pour section 122, and spread out into the joined sleeves 32, 34. The hydraulic ram then extends the rod 46 and attached plunger 38 toward the die end 42 of the joined sleeve 30, closing the pour hole 36 and forcing the molten metal through the interior passage 40 of the joined sleeve and into the die. The hydraulic ram then retracts the rod 46 and plunger 38, opening the pour hole 36, and preparing the shot sleeve for another run. However, unlike machines using conventional shot sleeves, when through repeated operation the pour section 122 erodes and deforms to such an extent that the die casting operation cannot continue, the removable sleeve 34, which contains the deformed pour section, can be easily replaced.

To replace the removable sleeve 34 the hydraulic ram is activated to retract the rod 46 and plunger 38 completely out of the removable sleeve 34. The fixed and removable sleeves 32, 34 are then disconnected in a manner respective of the particular means of securement, such as those discussed above. For example, the removable sleeve 34 is unthreaded or the wedges are removed, and the removable sleeve 34 is slid off of the fixed sleeve 32 and removed. The removable sleeve 34 being generally of a considerably lesser length than the fixed sleeve 32, it is relatively light weight and easy to handle promoting quick and easy replacement. Replacement time and resulting downtime is further reduced since the fixed sleeve need not be removed from the die platen, a disconnection which is often particularly cumbersome.

Moreover, since, as is mentioned above, the removable sleeve 34 is generally substantially shorter than the fixed sleeve 32, a substantial amount of the steel is salvaged, namely that in the fixed sleeve. This results in considerable material savings because a lesser amount of relatively expensive steel need be replaced. Manufacturing costs may also be reduced since the removable sleeve is smaller than conventional shot sleeves.

In an alternate embodiment, the pour section 122 of the removable sleeve 34 may be covered with a ceramic material to prolong the life of the removable sleeve. As the pour section 122 is located approximately directly below the pour hole 36, and high pressure is not developed in the molten metal until after the plunger 38 closes the pour hole 36, the ceramic material should be free from the high pressure stresses which have caused significant problems when ceramics have been employed in die casting machines in the past. Alternatively, the removable sleeve 32 itself may be composed of a suitable ceramic material and secured to the fixed sleeve 32 by some means, such as the locking cam mechanism described above, providing for relative radial expansion between the sleeves.

Figure 11:
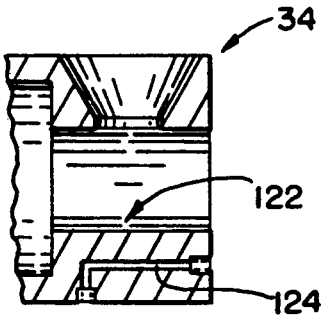
FIG. 11 shows a two-piece shot sleeve with cooling lines below the pour section to improve the life of the removable sleeve.

Another embodiment which will prolong the life of the removable sleeve 34 includes cooling the pour section 122 of the removable sleeve as shown in FIG. 11. Water lines 124 are bored through the removable sleeve 34 so as to pass immediately below the pour section 122. Suitable fittings are supplied on the removable sleeve 34 and connected to appropriate water inlet and outlet lines. As molten metal flows across the pour section 122, heat is conducted away from the pour section along a thermal gradient to the water lines 124. Cooling the pour section 122 in this manner acts to slightly inhibit the chemical reaction between the molten metal and the removable sleeve 34, thus slowing the erosion process.

Figure 12:
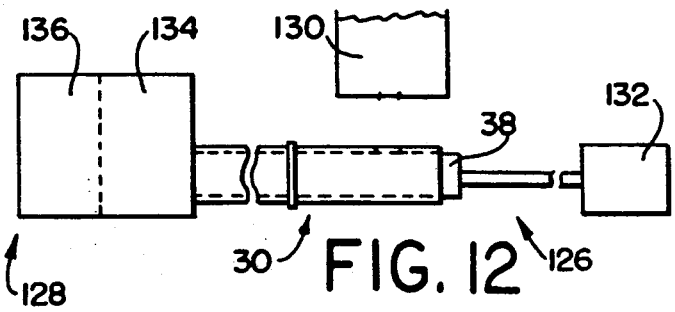
FIG. 12 is a schematic illustration of a die casting machine employing the present invention.

Referring to FIG. 12 there is illustrated a die casting machine 126 employing the shot sleeve 30 of the present invention. The die casting machine includes a die 128, a supply of molten metal 130, a shot sleeve 30 for conducting the molten metal to the die, and a plunger 38 and hydraulic ram 132 for forcing the molten metal through the sleeve and into the die. The die 128 itself usually includes a fixed portion 134, called a platen, and at least one removable section 136 for allowing access to the cooled casting. When employed as described above, the die casting machine facilitates the removal and replacement of the wearing area of the shot sleeve resulting in a less expensive and less time-consuming overall operation.

While a number of ways of securing the fixed and removable sleeves of the invention are enumerated and described in detail above, these are but a few of the many ways in which the sleeves could be secured as will be appreciated by one skilled in the art. Likewise although the invention is described with reference to a particular method of filling the shot sleeve with molten casting metal, namely automatic or manual ladling, other methods such as a controlled reservoir, to name but one, may be used while still achieving the advantages and spirit of the invention.

What is claimed is:

1. A two-piece shot sleeve for use with a die casting machine; comprising:

first and second cylindrical sleeve sections, each sleeve section being of homogeneous, single-piece construction and being open at both ends, each sleeve section including interior passage means for contact with molten metal and for the flow of molten metal therethrough, and each sleeve section including mounting means for removably transversely securing with other of said sleeve sections to align the respective interior passage means in axial series to permit the flow of molten metal from one such interior passage means to another interior passage means and ultimately into said die, said second sleeve section also including opening means for receiving molten metal into said interior passage.

2. A device as set forth in claim 1, wherein said mounting means of said second sleeve includes a threaded annular recess, and said mounting means of said first sleeve section includes a threaded cylindrical extension for threaded engagement with said threaded annular recess of said second sleeve section.

3. A device as set forth in claim 1, wherein said mounting means includes a plurality of wedges and a plurality of square recesses in said first and second sleeves, said wedges being operable to secure said first and second sleeves together when inserted in said square recesses.

4. A device as set forth in claim 1, wherein said mounting means includes employing dowel rods to align said first and second sleeve sections and bolts to secure said first and send sleeves firmly together.

5. A device as set forth in claim 1, wherein said mounting means includes a plurality of double-acting cams and a plurality of square recesses in said first and second sleeve sections, said cams being operable to secure said first and second sleeve sections firmly together when fixed in said recesses and rotated 180 degrees.

6. A device as set forth in claim 1, wherein said first and second sleeve sections are constructed of steel.

7. The two-piece shot sleeve of claim 1 in combination with a die casting machine including a die.

8. The combination of claim 7, wherein said first sleeve section is secured to such die.

9. The combination of claim 8, wherein said second sleeve section is removable from said first sleeve section while said first sleeve section remains secured to such die.

10. A die casting machine comprising:

a die;

a source of molten liquid for casting;

a two-piece shot sleeve including a die end section and a pour end section, each section being of a single-piece homogeneous construction and including an interior passage means for contact with molten liquid and for the flow of molten liquid therethrough and each section being transversely securable together in axial series;

a plunger disposed within said interior passage means for forcing such molten liquid through such interior passage means in series and into said die; and, a ram for moving said plunger axially within said shot sleeve;

wherein said pour end section of said two-piece shot sleeve is removable from said machine without removing said die end section.

11. A two-piece shot sleeve for use with a die casting machine, comprising:

first and second cylindrical sleeve sections, each sleeve section being of a homogeneous, single-piece construction and being open at both ends, each sleeve section including interior passage means for contact with molten metal and for the flow of molten metal therethrough, and each sleeve section including mounting means for securing in threaded engagement said sleeve section with other of said sleeve sections, in axial series thereby to align the respective interior passage means thereof in fluid flow axial series to permit the flow of molten metal from one such interior passage means into another interior passage means aligned therewith, and said mounting means permitting selective removal of said second sleeve section from securement with said first sleeve section while said first sleeve section remains affixed in such die casting machine, said second sleeve section also including opening means for receiving molten metal into said interior passage.

* * * * *